US005182461A

United States Patent [19]

Baran

[11] Patent Number: 5,182,461

[45] Date of Patent: Jan. 26, 1993

[54] SWITCHING MECHANISM FOR APPLIANCE CONTROLLER

[75] Inventor: Michael Baran, Wauwatosa, Wis.

[73] Assignee: Eaton Corporation, Cleveland, Ohio

[21] Appl. No.: 589,856

[22] Filed: Sep. 28, 1990

[51] Int. Cl.[5] ..... H01H 3/42; H01H 43/10

[52] U.S. Cl. ..... 307/41; 200/38 C; 335/185; 307/139

[58] Field of Search ..... 200/38 C, 38 R, 38 CA, 200/38 B, 38 FA, 38 A; 335/190, 191, 192, 185; 307/41, 112, 116, 139, 141, 142, 143, 141.4; 361/160, 190

[56] References Cited

U.S. PATENT DOCUMENTS

| | | | |
|---|---|---|---|
| 3,271,877 | 9/1966 | Guenther, Jr. et al. | 34/45 |
| 3,413,425 | 11/1968 | Lovegrove | 200/38 C |
| 3,737,820 | 6/1973 | Harris | 335/65 |
| 4,521,722 | 6/1985 | Barthel et al. | 200/38 B |
| 4,626,635 | 12/1986 | Mahon | 200/38 FA |
| 4,743,820 | 5/1988 | Veach | 200/38 B |

FOREIGN PATENT DOCUMENTS 1360597 3/1964 France .

*Primary Examiner*—A. D. Pellinen
*Assistant Examiner*—Richard Elms
*Attorney, Agent, or Firm*—R. A. Johnston

[57] ABSTRACT

A programmer for controlling the actuation and deactuation of a plurality of load function switches. A motorized cam drum track moves a follower pivoted about a fulcrum pin. A solenoid controlled by a microcomputer slidably moves a bar operable to selectively latch and unlatch the fulcrum pin. When latched, the pin causes the follower to pivot and effect the actuation and deactuation of the associated switch in response to the cam track and the follower, when the fulcrum is unlatched, leaving the switch unmoved. The solenoid controls latching and unlatching independently of the cam drum rotation.

12 Claims, 4 Drawing Sheets

SWITCHING MECHANISM FOR APPLIANCE CONTROLLER

BACKGROUND OF THE INVENTION

The present invention relates to program controllers or programmers, as they are sometimes called, which are employed for sequentially actuating a plurality of switches for controlling various functions of an appliance or other device to be controlled. Controllers of this type are commonly employed for household appliances, such as dishwashers, clothes washing machines, clothes dryers, and cooking appliances. Typically in such appliance controllers, a subfractional horsepower timing motor drives an advance mechanism for effecting rotation of a cam drum; and, individual tracks on the cam drum sequentially actuate and deactuate program function switches as the cam drum is rotated through a complete revolution which comprises the desired program interval.

In such controllers where a rotatable cam drum is employed for programming the actuation and deactuation of the appliance control switches, the accuracy and degree of sophistication of sequencing the switches is limited by the drum diameter, the configuration of the cam and the rate of advance of the cam. Because of such limitations, it has been desired to find alternative ways of controlling the program function switches in an appliance to avoid the limitations of a sequentially advanced cam track.

In attempting to overcome such limitations, appliance programmers having solid state electronic switching devices have been employed. However, such solid state switching devices have required the use of relays where switching of heavy current is required for controlling motor starting and other functions requiring a substantial current draw. The cost of providing such components to the appliance programmer or controller has rendered the electronic controller noncompetitive against equivalent electromechanical programmers in high volume mass produced household appliances.

Thus, a need has arisen for finding a way or means of controlling the program sequence of appliance functions in a manner which can provide for the switching of substantial current as, for example, the starting current for a main drive motor, and yet provide for a programmed sequence control which is not limited by the positioning of sequentially advanced cams on a rotating cam drum. It has thus been desired to employ the sophistication and the variety of control sequence programming available from a programmed microcomputer or microprocessor, which can provide for control of the appliance functions independently of a timed rate of rotation of a cam.

Accordingly, it has been desired to find a technique or a way of providing a plurality of individual switches for controlling selected appliance functions which draw substantial current and to control the sequence or program of operation of such functions with a microcomputer. It has further been desired to provide such programmed controlling in a manner which is low enough in cost to enable the resultant programmer to be used in mass produced household appliances which are sold in a highly competitive marketplace.

SUMMARY OF THE INVENTION

The present invention provides an appliance programmable controller which utilizes a cyclically operated mechanism such as a rotating cam drum for causing actuation of one or more appliance function switches Each revolution or cycle of the cam drum causes a cam follower for each switch to be moved. A slidable member for engaging a pivot surface on each cam follower for defining a fulcrum is moved by an electrically energized actuator, preferably a solenoid, which is controlled by electronic circuitry, including a microcomputer having the desired program sequence for the appliance programmed therein. When the solenoid is energized to cause the slidable member to engage the pivot surface on the cam followers, the followers are operative in response to the cam tracks to move the switches to the actuated condition. When the solenoid is not energized, the cam followers float and have no effect on the switches.

The present invention thus enables the program sequencing of the appliance control function switches to be independent of the timed rotation of the cam drum by latching or unlatching the fulcrum of the cam followers to provide operative or inoperative followers as desired at any point in time during the rotation of the cam. Current switching for respective individual appliance functions is thus handled reliably and inexpensively by mechanical switches; and, the program logic, lodged in a microcomputer, need only control the switch cam follower fulcrum latching solenoid. The "hybrid" controller of the present invention has been found particularly suitable for appliance applications having a main drive motor which draws substantial current with inductive reactance upon start up, and which would require prohibitively costly solid state switching devices to withstand the current surge.

BRIEF DESCRIPTION OF THE DRAWINGS

The foregoing will be more readily apparent upon reading the following description in conjunction with the drawings wherein.

DETAILED DESCRIPTION

Figure 1:
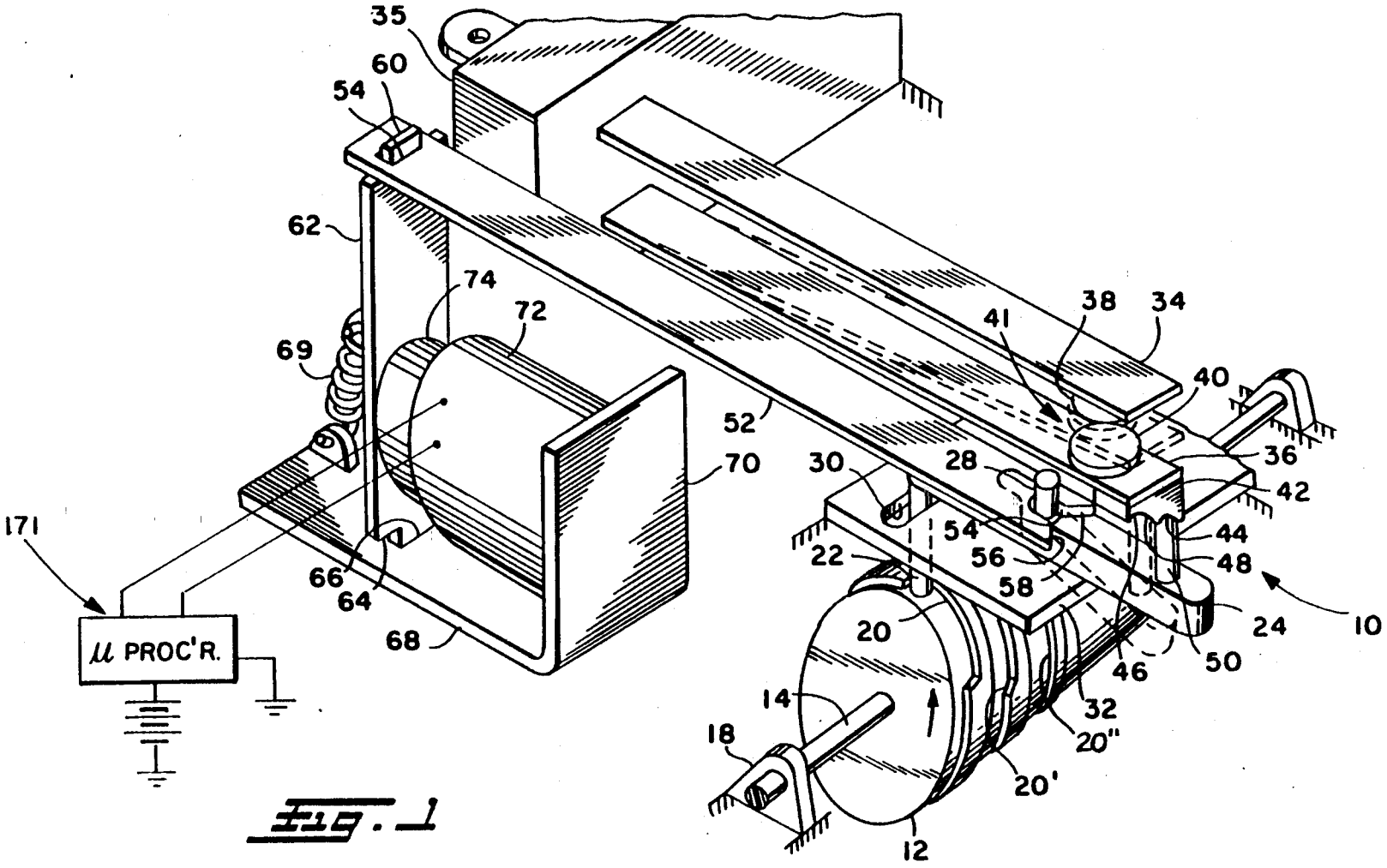
FIG. 1 illustrates a first embodiment of the switching mechanism for an appliance controller with the principles of this invention.

Referring to FIG. 1, the invention is illustrated in the presently preferred practice, in a first embodiment comprising an assembly indicated generally at 10 having a cam drum 12 mounted on a shaft 14. Drum 12 is adapted to be rotationally advanced by any suitable mechanism as, for example, motorized drive connected to shaft 14 or a ratchet and pawl type advance mechanism, both of which are well known in the art, and which have been omitted from the drawings for the sake of simplicity.

Drum 12 has at least one peripheral cam track 20 thereon which has a cam follower in the form of a pin 22 riding therein for movement in an axial direction in response to rotation of the drum 12. Pin 22 depends vertically downward from one end of a bar or lever 24, with an intermediate pin 28 extending upwardly from the mid-length region of the bar 24. Pin 22 is received in a slot 30 formed in a stationary deck plate 32. Pin 22 is sized to permit free sliding traverse in the slot 30.

A stationary insulator block 35 has extending therefrom in a generally spaced parallel cantilever relationship, an upper and lower switch blade arm denoted by reference numeral 34, 36 respectively. The upper blade arm 34 has an electrical contact 38 exposed on the lower surface thereof adjacent the free end, and a lower blade 36 has a similar contact 40 disposed on the upper surface thereof directly below contact 38. The lower blade arm 36 has a cam block 42 provided on the free end thereof extending downwardly from the undersurface of the blade arm. Block 42 has a contoured surface provided on the underside thereof having a "HIGH" detent surface 44 and a "LOW" detent surface 46 adjacent thereto in a transverse direction. The ramp surface 48 interconnects the "HIGH" and "LOW" detent surfaces 44, 46. The cam block 42 is biased in a downward direction by the lower blade 36 such that either of the cam detents 46, 48 contacts the end of a pin 50 which extends upwardly from bar 24 adjacent the end thereof.

A locking bar or plate 52 is slidably received along the upper surface of bar 24 and has a notch 54 provided in one end thereof which notch has tapered ends 56, 58, and has the sides thereof configured to engage pin 28 in free-sliding engagement. The opposite end of lock bar 52 has an aperture 58 provided therein.

An armature bar 62 has a tab 60 provided on one end thereof and which tab 60 extends into aperture 54 of the locking bar 52. Armature 62 is disposed vertically, with the opposite or lower end 64 extending through an aperture or notch 66 formed in a stationary plate 68. Plate 68 has an upturned vertical portion 70 which has mounted thereto a solenoid coil 72 with an iron core 74 disposed adjacent the armature 62.

Referring to FIGS. 1 though 5, the operation of the assembly 10 will be described wherein the locking bar 52 is shown in FIG. 1 in solid outline in the position locking pin 28 in the slot 54, thereby creating a fulcrum for the bar 24 about a vertical axis passing through pin 28. The locking bar 52 is shown in dashed outline in FIG. 1 in a position releasing pin 28 from the slot 54 in which position the bar 24 is permitted to float.

The locking bar 52 is moved to the release position shown in dashed outline in FIG. 1 upon de-energization of the solenoid 72 under the urging of spring 69. Energization of the solenoid 72 moves the armature 62 to the position placing the locking bar 52 in the rightward position or position shown in solid outline in FIG. 1.

The coil 72 is energized at the desired time and de-energized at the desired elapsed time interval after energization by a preselected program in a microprocessor indicated generally at 71 to supply the desired appliance function.

Figure 6:
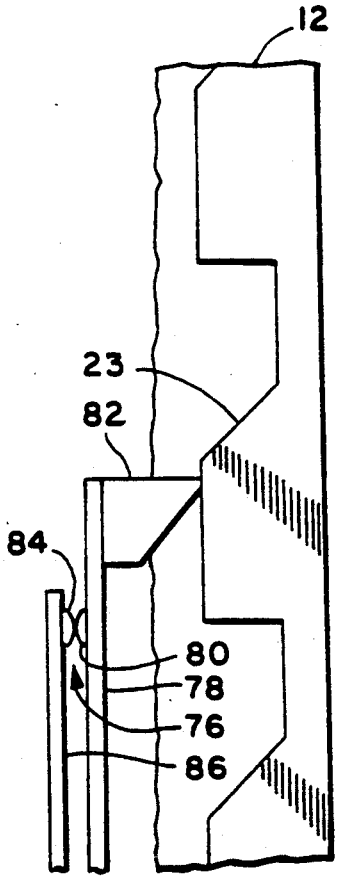
FIG. 6 illustrates the camming track and cam follower used to operate the switch in a detailed view of a portion of the switching mechanism of FIG. 1.

Referring to FIGS. 1 and 6, a timing track denoted 23 is provided on the cam drum 12 and provides periodic opening and closing of an auxiliary switch indicated generally at 76 in FIG. 6. Switch 76 has a movable resilient contact blade 78, having a contact 80 provided thereon and a cam follower 82 provided on the end of the blade 78 for opening and closing against a contact 84 provided on a second substantially stationary switch blade 86. The switch 76 is connected to the same microcomputer 71 associated with the switch 41 and coil 72. Switch 76 is opened and closed cyclically at a desired frequency by the track 23 at a desired frequency for each revolution of the cam drum 12, and thereby provides a position signal to the microcomputer for locating the individual cam track 20 on the drum with respect to the cam follower pin 22.

It will be understood that although only one cam and latch operated switch 41 and associated coil 72 is illustrated in the drawings, that additional switches may be provided adjacent thereto and operated by the additional adjacent cam tracks provided on the drum which are indicated in FIG. 1 and denoted by reference numerals 20' and 20" respectively.

Figure 4:
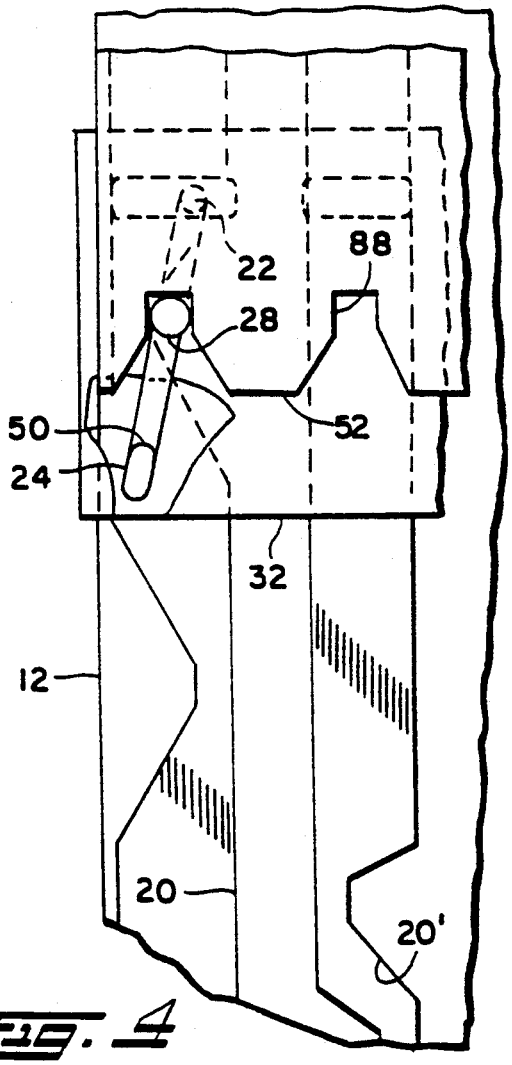
FIG. 4 illustrates a latched condition of the locking bar providing a fulcrum to open the switch in a detailed view of a portion of the switching mechanism of FIG. 1.

Such additional switches (not shown) are to be operated by the additional cam tracks 20' and 20" and may be conveniently latched by additional notches in the slider bar 52 such as the notch 88 shown in an extended portion of the slider 52 as illustrated in FIG. 4. It will be understood that the slider bar 52 is truncated in an axial direction with respect to the drum 12 in the drawing. Cam tracks 20 and 20" are staggered circumferentially to operate switches at different positions of the cam drum.

Figure 2:
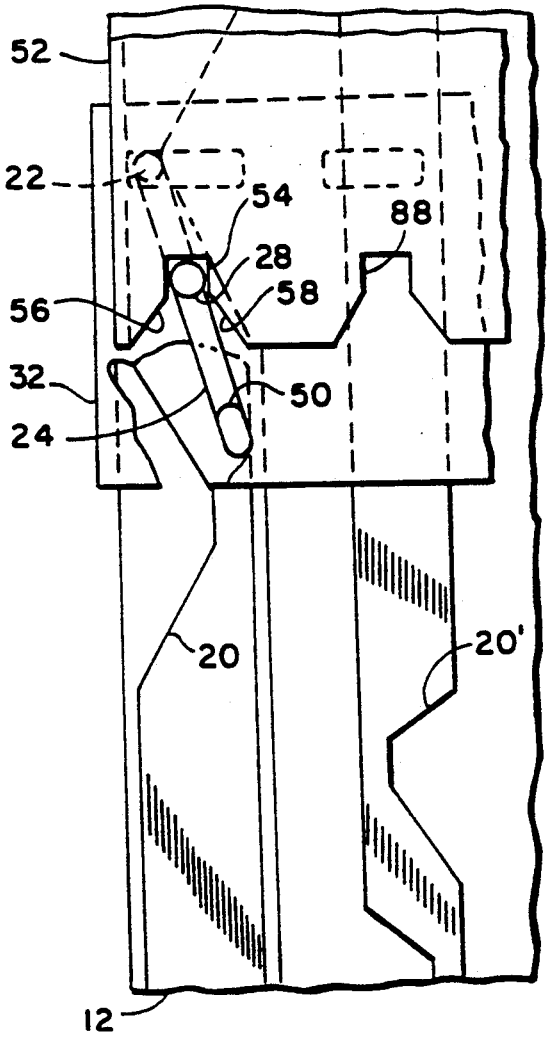
FIG. 2 illustrates a latched condition of the locking bar providing a fulcrum to close the switch in a detailed view of the switching mechanism of FIG. 1.

Referring to FIGS. 2 and 4, locking bar 52 is shown as extended in an axial direction with respect to the drum 12 by an amount to include the portion thereof having formed therein a second notch 88 adapted for engaging a cam follower bar pin (not shown) associated with the cam track 20'. It will be understood that locking bar 52 may be extended further in the axial direction to provide additional notches for pins associated with a cam follower bar (not shown) employed in conjunction with additional cam track 20".

Figure 3:
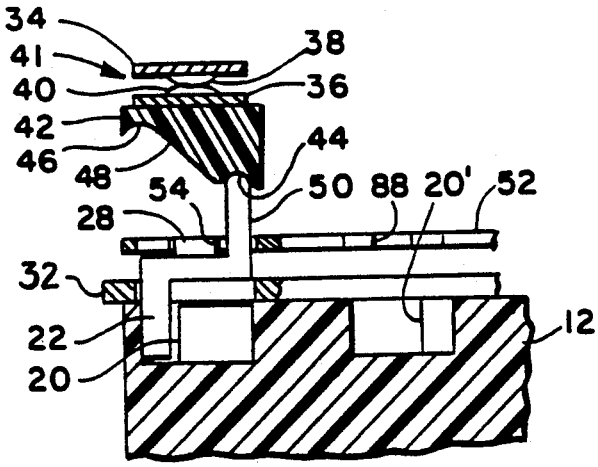
FIG. 3 illustrates a closed switch during a latched condition in a detailed view of a portion of the switching mechanism of FIG. 1.

Referring to FIGS. 2 and 3, the sliding locking bar 52 is shown in the position locking pivot pin 28 in a fixed axial position as a fulcrum for the bar 24 as is the case when the solenoid 72 is energized. The cam follower pin 22 of bar 24 is moved leftward and the cam pin 50 is shown moved rightward by cam track 20 so that the pin 50 has cammed against ramp surface 48 to detent 44 thereby raising the follower 42 to close the switch 41 as shown in FIG. 3.

Figure 5:
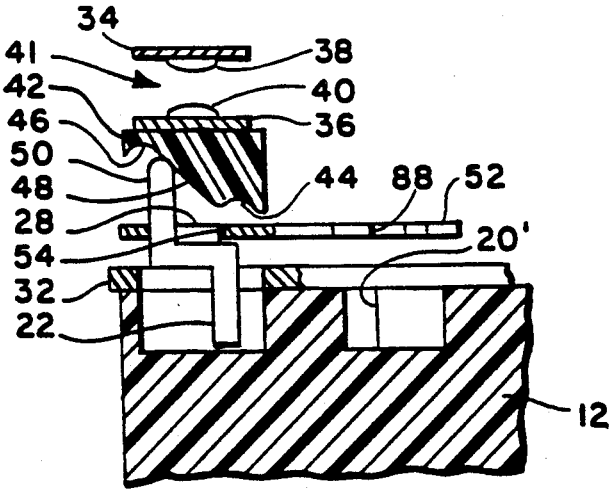
FIG. 5 illustrates an opened switch during a latched condition in a detailed view of a portion of the switching mechanism of FIG. 1.

Referring to FIGS. 4 and 5, further advancement of the cam track 20, with the locking bar 52 remaining in the position shown in FIG. 2, that is, with the pin 28 received in notch 54, the cam follower 22 is moved causing cam pin 50 to move to detent 46, thereby permitting the follower block 42 and switch blade 36 to move downwardly opening switch 41.

It will be understood that when the solenoid is de-energized, sliding lock bar 52 is moved to the position shown in dashed outline in FIG. 1, and the bar 24 is free to float in the cam track 20 and slot 30, and the pin 50 is maintained in its position in a cam block 42, either in detent 44 or 6, and the condition of switch 41 remains unchanged. It will thus be seen that the rate of rotation of drum 2 may be set such that switch 41 may be controlled to open and close rapidly, yet the interval of closure is controlled independently of the rate of rotation of the drum and is accomplished by control of the solenoid 72, from a suitable electronic control circuit indicated generally at 71 programmed as desired. It will be further seen that although the slider bar 52 may contain plural notches for latching a plurality of switch bars, only one is illustrated in FIG. 1. The timing cam track 23 and timing switch 76 enable the electronic control circuit to effect movement of the bar 52 at the desired position of the cam track 20. If desired, additional bars (not shown) may be disposed to follow tracks 20' and 20'' which to effect the desired latching of the respective associated cam follower bar.

Figure 8:
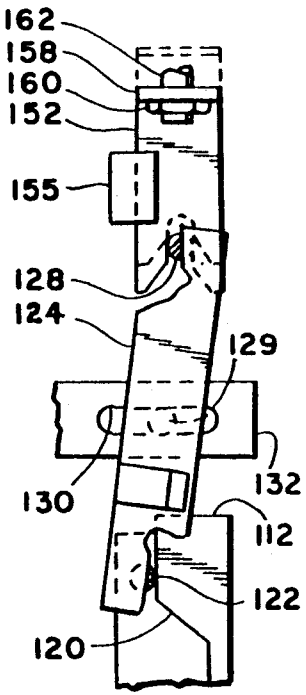
FIG. 8 illustrates latching and unlatching conditions of the pivot bar in a detailed view of a portion of the switching mechanism of FIG. 7.
Figure 7:
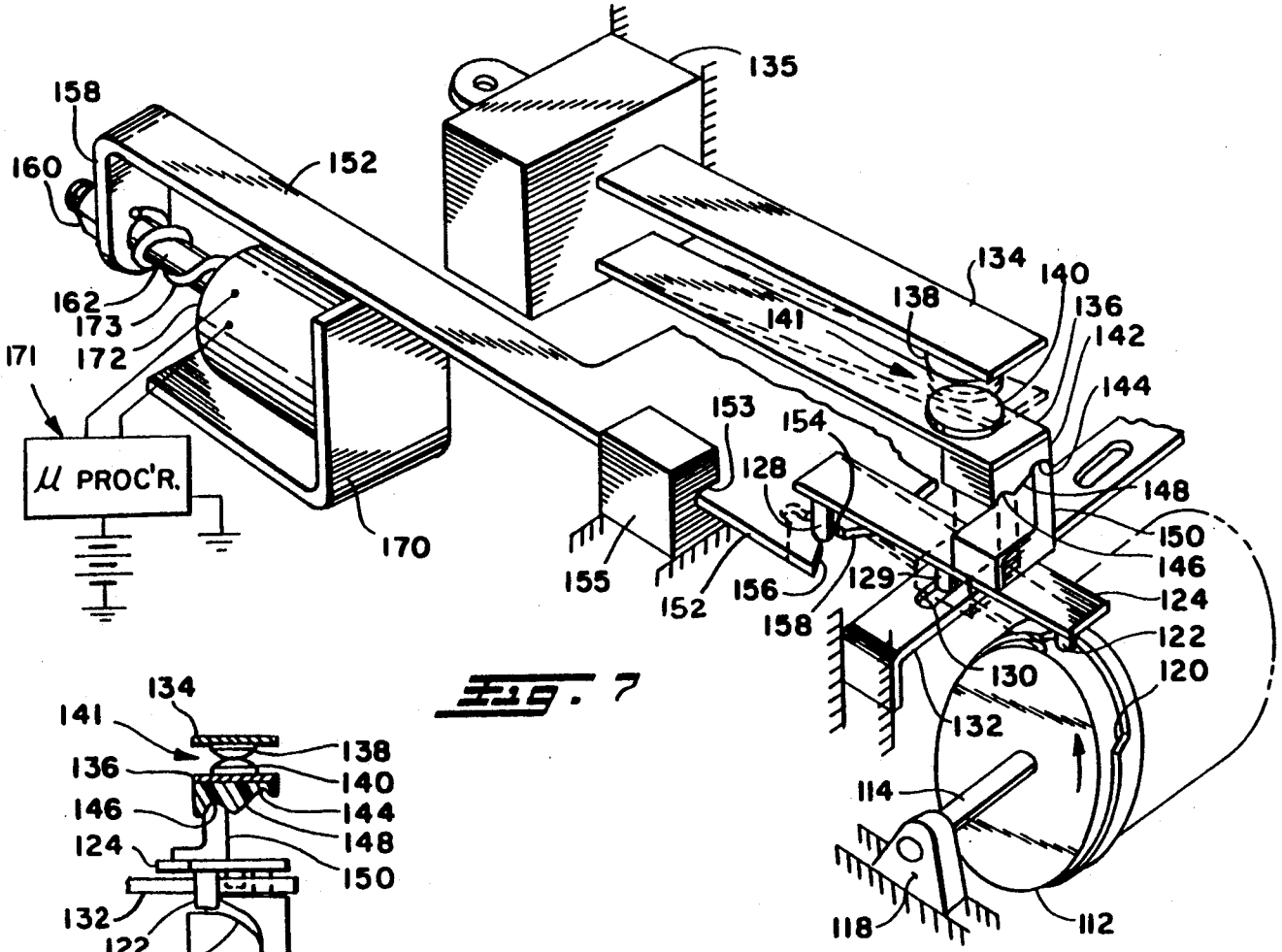
FIG. 7 illustrates a second embodiment of the switching mechanism in accordance with the principles of this invention.
Figure 9:
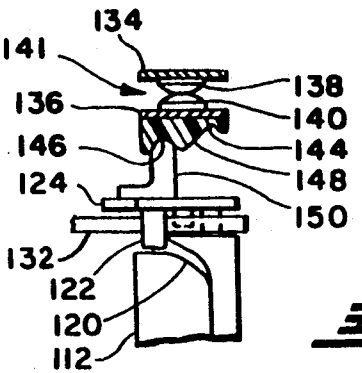
FIG. 9 illustrates a closed switch in a view of a portion of the switching mechanism of FIG. 7.

Referring to FIGS. 7, 8, and 9, an alternate embodiment of the invention is illustrated wherein the motorized cam drum 112, rotating about shaft 114 journalled in a stanchion 118 and having a cam track 120 thereon with a follower 122 attached to pivot bar 124 and having pivot pin 128 extending downwardly therefrom and a guide pin 129 slidably received in a guide slot 130 formed in a stationary member 132.

An upper switch contact blade 134 is cantilevered from a stationary insulator block 135. A lower switch blade 136 also extends in cantilever from block 135 in generally space parallel arrangement with the upper blade 134. An upper contact 138 is disposed on the undersurface of contact blade 134; and, a lower contact 140 is disposed on the upper surface of lower contact blade 136, and aligned directly below contact 138, thereby forming a switch indicated generally at 141. A follower block 142 is attached to the free end of the lower switch blade 136 and extends downwardly therefrom and has a high-level detent 146 formed therein and a low-level detent 144 which surfaces are interconnected by a ramp 148. A lift pin or block 150 is provided on pivot bar 124 and extends upwardly therefrom to engage the cam surfaces 144, 146, 148 on the underside of block 132.

A slider bar 152 has a slot 154 provided in the end thereof which engages the sides of pin 128. The ends of the slot 154 are chamfered at 156, 158 to facilitate engagement of the pin 128. The slider bar 152 is received in sliding engagement slot 153 provided in a stationary guide block 155. The end of slider bar 152 opposite the slot 154 has an upwardly turned tab 158 which has attached thereto one end of an armature rod 162, which is attached to the tab 158 by a nut 160 threadedly received thereover. A stationary bracket on plate 170 has a solenoid coil 172 mounted thereon, which is adapted to be energized by a suitable control circuit indicated generally at 171 in accordance with a predetermined program. A spring 173 biases rod 162 outwardly of coil 172.

In operation, de-energization of the solenoid permits spring 173 to move the slider bar 152 to the position shown in dashed outline in FIG. 7, thereby releasing the notch 154 from pin 128, and permitting the pivot bar 124 to float. Upon energization of the solenoid, slider 152 engages pin 128, overcoming the bias of spring 173, thereby providing a fulcrum for the pivot bar 124 which is moved to the position shown in dashed outline in FIG. 7 by pin 122 tracking the cam track 120. Movement of the pivot bar 124 to the position shown in dashed outline in FIG. 7 results in the block 150 moving to the position shown in FIG. 9 wherein the member 150 moves along the ramp surface 148 to the "HIGH" detent 146, thereby raising the lower switch blade 136 and closing the switch 141. It will be understood that in this latter aspect, the embodiment of FIGS. 7, 8, and 9 functions in a manner similar to that of the embodiment of FIG. 1.

The present invention thus provides a unique and novel programmer for appliances and which employs mechanically actuated electrical contacts with one contact moved by a cam follower, following a track on a rotating drum. The cam follower fulcrum pin is latched and unlatched by a sliding bar, movable by the armature of a solenoid which is energized independently of the cam drum rotation by an electronic control circuit employing a microcomputer programmed in a desired manner. The control circuit microcomputer is advised of the relative position of the cam track by a separate timing or position track provided on the drum and operating a separate switch for providing a signal to the microcomputer. The present invention thus provides for suitable electrical contacts capable of carrying current loads which would require prohibitively expensive solid state electronic devices for switching, and yet retains the flexibility of programming made available by the use of a microcomputer.

Although the present invention has hereinabove been described with respect to the illustrated embodiments, it will be understood that the invention is capable of modification variation by those skilled in the art, and is limited only by the scope of the following claims.

I claim:

1. A programmable switching array comprising:

(a) at least one electrical switching means each having a set of contacts with one contact movable for making and breaking electrical contact therebetween;

(b) cam means adapted to be cyclically driven;

(c) follower means having a pivotable condition and a floating condition, and operable in said pivotable condition to be pivoted about a fulcrum by said cam means and effect said making and breaking of said set of contacts;

(d) latchable means having a latched condition and an unlatched condition, and operable in said latched condition to provide said fulcrum for said follower means, and operable in said unlatched condition to enable said follower means floating condition;

(e) actuator means operable for upon electrical energization and de-energization to move said latchable means between said latched condition and said unlatched condition; and, (g) circuit means, including microcomputer means, operable to energize and de-energize said actuator means in a pre-programmed sequence.

2. The switching array defined in claim 1, wherein said cam means comprise a rotary cam drum.

3. The switching array defined in claim 1, wherein said electrical switching means comprise a plurality of electrical switches;

(a) said cam means comprises a rotary cam drum with a plurality of cam tracks; and, (b) said follower means includes an individual follower member associated with each of said switches.

4. The switching array defined in claim 1, wherein:

(a) said cyclic cam means includes a cam drum having a plurality of cam tracks thereon; and, (b) said at least one electrical switching means includes a plurality of switches each having a cam follower following one of said cam tracks.

5. The switching array defined in claim 1, wherein, said cam follower means includes lever means pivotable at one end thereof by said latchable means in said latched condition.

6. The switching array defined in claim 1, wherein said cam follower means includes lever means pivotable at a location thereon intermediate the ends thereof.

7. The switching array defined in claim 1, wherein, (a) said cam means includes a rotating cam drum; and, (b) said latchable means includes a member slidably movable in a direction generally tangentially with respect to said drum.

8. The switching array defined in claim 1, wherein:

(a) said follower means includes a follower member having an inclined surface thereon;

said switching means includes a cantilever blade having said follower member associated therewith; and, (c) said cam means includes a rotating drum having a track thereon operable to engage said follower member.

9. The switching array defined in claim 1, wherein:

(a) said cam means includes a rotating cam drum having a cam track thereon; and, (b) said cam follower means includes lever means having a pivotal axle generally perpendicular to a tangent to said drum; and, (c) said latchable means includes a member engaging said axle in said latched condition.

10. The switching array defined in claim 1, wherein (a) said cam means includes a rotating member having a peripheral cam track thereon;

(b) said follower means includes pivot means defining a fulcrum surface and lever means pivotable about said fulcrum surface; and, (c) said latchable means includes a member movable to engage said fulcrum surface in said latched condition and to be disengaged from said fulcrum surface in said unlatched condition.

11. The switching array defined in claim 1, wherein said follower means comprises a pivotable member associated with each of said at least one switch; and, said latchable means comprises a single member movable between a first and second position for latching and unlatching said pivotable fulcrum.

12. The switching array defined in claim 1, wherein:

(a) said cam follower means comprises a lever member pivotable about a fulcrum and, (b) said latchable means includes a member movable between a first position locking the fulcrum for said level member and a second position operable to effect said unlatched condition of the fulcrum for said lever pin member.

* * * * *